US005474173A

United States Patent [19]

Hodapp

[11] Patent Number: 5,474,173

[45] Date of Patent: Dec. 12, 1995

[54] PROMOTIONAL CARD INSERT DISPLAY SYSTEM

[75] Inventor: Armand Hodapp, Naperville, Ill.

[73] Assignee: Wisconsin Label Corporation, Algoma, Wis.

[21] Appl. No.: 258,404

[22] Filed: Jun. 13, 1994

[51] Int. Cl.[6] ..... B65D 71/06

[52] U.S. Cl. ..... 206/232; 206/150

[58] Field of Search ..... 206/141, 145, 206/147, 150, 151, 158, 161, 232, 427, 432, 459.5

[56] References Cited

U.S. PATENT DOCUMENTS

| | | | |
|---|---|---|---|
| 3,055,497 | 9/1962 | Brunsing | 206/459.5 |
| 3,713,532 | 1/1973 | Tanzer | 206/145 |
| 4,000,814 | 1/1977 | Stout | 206/459.5 |
| 4,316,538 | 2/1982 | Manizza | 206/459.5 |
| 4,453,664 | 6/1984 | Oliff | 206/459.5 |
| 4,487,312 | 12/1984 | Heider | 206/158 |
| 4,520,924 | 6/1985 | Edwards et al. | 206/150 |
| 4,911,290 | 3/1990 | Karabedian et al. | 206/150 |
| 5,018,620 | 5/1991 | Marco et al. | 206/150 |

FOREIGN PATENT DOCUMENTS

| | | | |
|---|---|---|---|
| 110595 | 3/1967 | Norway | 206/153 |

*Primary Examiner*—Jimmy G. Foster
*Attorney, Agent, or Firm*—Eugene Stephens & Associates

[57] ABSTRACT

A promotional card insert is used in combination with beverage bottle holders and beverage bottles to create a promotional card insert display system. The bottle holder preferably holds two rows of bottles about their mid-sections so that the bottles of one row are in contact with the bottles of the other row. The holder can have an integral handle on its periphery. The insert has text and/or graphics printed on its surfaces, is placed between the bottles from above, and is held in place by the compressive force of the bottles. By virtue of its placement in the pack and the location of the holder, the card is visible between the necks of the bottles, whether in individual packs or stacks of packs. The insert can be a single-panel card or can be made using multiple folded panels. The insert can also include promotional gifts or prizes, such as bumper stickers, static-cling display devices, and posters, either placed inside the insert or formed as part of the card.

21 Claims, 3 Drawing Sheets

PROMOTIONAL CARD INSERT DISPLAY SYSTEM

BACKGROUND OF THE INVENTION

Beverage companies are enthusiastic about promoting their products and do so in many ways. One popular promotion technique is to have a stack of product arranged on an end cap of a store aisle with a promotional poster or other display nearby to catch the customer's eye. Some displays are independently supported, while some actually rest on the product. Independently supported displays can be difficult to arrange since the product can interfere with the support structure. Displays which rest on the product can fall down when bumped by customers or when the product which supports it is removed.

Another way beverage companies promote their products is to have a smaller display near the normal location of the product. Here the difficulty is visibility of the display. If the display is too small, it may not be noticed by customers. If it is too large, the display can frustrate customers by impeding access to or visibility of the very product it promotes.

Most types of promotional displays must be set up by employees of the beverage companies or the stores which sell the products, which can cause problems. Set up of displays introduces extra expense of time, energy, and money and can result in non-uniformity of displays from store to store.

The products beverage companies promote are packaged in a variety of ways. Stackable packs of bottles, especially in six- and eight-packs, are a popular type of packaging. Different types of holders are used to hold the together, some made from paper, some made from plastic, and many doubling as carriers for the pack. Most paper holders act like a box around the beverage bottles and have finger holes which allow packs to be carried more easily. Most plastic holders are sheets of plastic with holes which hold the necks of beverage bottles and have holes which can be used to carry the packs. The HI-CONE type of bottle holder is plastic, has rings which hold the bottles around their mid-sections, and has a handle on one edge to facilitate carrying of bottle packs. Other multi-pack bottle carriers formed of plastic in similar designs are also available.

In many instances, beverage companies use bottles, made from plastic or glass, which have recesses in their bottom ends. The recesses can receive top ends of like bottles, which enhance the stackability of the beverage bottle packs and facilitate their shipment, storage, and display. The bottles, whether made from plastic or glass, have necks which create gaps between the bottles. The bottles are often transparent; and, due to bottle-filling techniques, there is almost always empty space above the level of the beverage held in the bottles.

I have realized that beverage bottle packs which use plastic multi-pack configurations such as the HI-CONE holder present a new opportunity for promotional display. These holders are placed around the mid-section of the bottles, unlike other types of holders. As a result of its placement, these holders do not obstruct the gaps between the necks of the bottles they hold, allowing the interior of the packs to be seen. This is true of stacks of beverage bottle packs as well as individual packs. Even more space is visible when transparent bottles are used, whether they are clear, green, brown, or some other color; but transparency is not required.

SUMMARY OF THE INVENTION

The invention takes advantage of the visible empty space in prior art beverage bottle packs to provide additional promotional opportunity. In the preferred embodiment of the invention, a plastic holder is used which holds two rows of bottles and presses the rows of bottles together. The holder is preferably situated about halfway down the bottles.

A promotional card insert is placed between the rows of bottles and is held in place by the compressive forces between the bottles. When the card is placed according to the invention, the printed material on its exterior surfaces is visible between the necks of the beverage bottles. If transparent bottles are used, the printed material is also visible through the necks of the bottles.

An object of the invention is to provide a new way to promote products by inserting promotional cards in beverage bottle packs. A further object of the invention is to increase customer interest in the beverages with which the invention is used. The cards can be simple, single pieces of printed label stock; or they can be made using a piece of material with two, three, four, or more folded panels. Simple cards can be used with backing or release layers for bumper stickers, static-cling devices, or the like, which can then be directly inserted between the beverage bottles to increase customer appeal. A small poster can also be folded up and placed between the bottles as a promotional card insert.

Another object of the invention is to reduce the amount of in-store promotional display set up. Machinery is available which will insert the promotional card insert of the invention into beverage bottle packs as the packs are assembled. The promotional display system is thus complete, nearly so, at the bottling facility. All that remains to be done at the store is to stack the beverage bottle packs in an appropriate location. The invention can be used alone or in conjunction with traditional promotional displays.

DESCRIPTION OF THE PREFERRED EMBODIMENT

The invention is a novel combination of a promotional card insert 3, a prior art bottle holder/carrier 1, and prior art bottles 2. The bottle holder 1 is preferably a plastic multi-pack bottle carrier available for holding six- or eight-packs of twelve-, sixteen-, and twenty-ounce bottles 2. Suitable plastic multi-pack bottle carriers are available from the HI-CONE Division of ITW; Owens-Brockway of Toledo, Ohio; and other manufacturers. Other holders can be used as long as they press the bottles together as described below and are positioned below the necks of the bottles.

Figure 1:
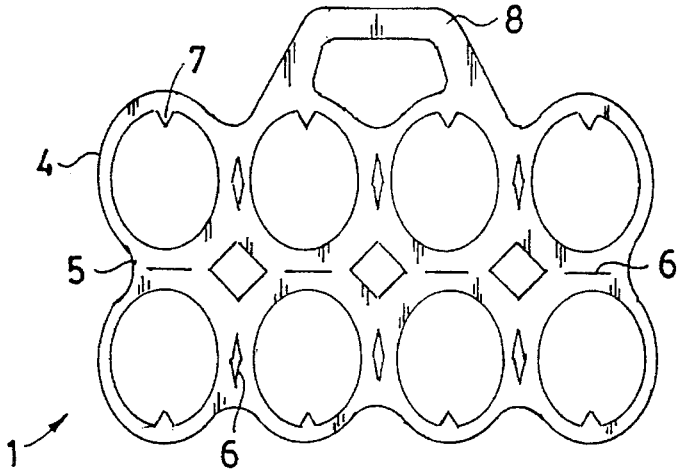
FIG. 1 PRIOR ART
FIG. 1 is a top view of the prior art bottle holder/carrier.
Figure 2:
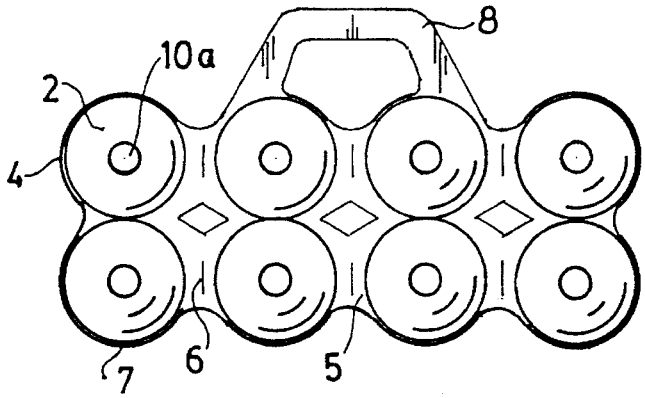
FIG. 2 PRIOR ART
FIG. 2 is a top view of the prior art bottle holder/carrier with the prior art bottles inserted to form a beverage bottle pack.
Figure 4:
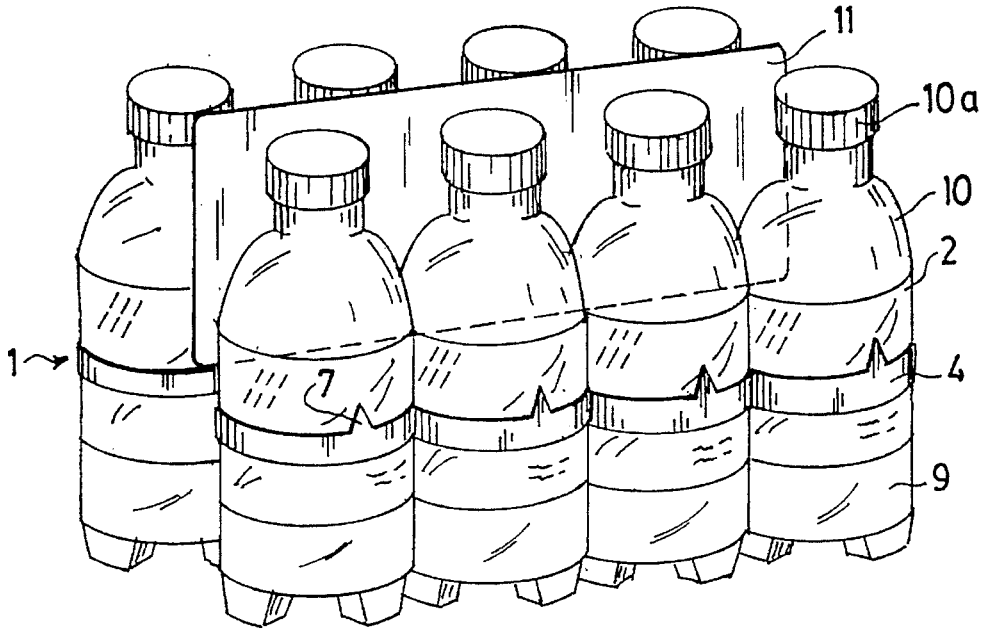
FIG. 4 is a side elevation of the prior art bottles in the bottle holder with the promotional card insert positioned according to the invention.

Referring to FIG. 1, the holder 1 is preferably die cut from a sheet of plastic and has two rows of rings 4 which hold the bottles 2. Plastic is left between the rings to form connective webbing 5. Slits 6 are die cut in the webbing between the rings to allow easy separation of the rings and their respective bottles from the rest of the carrier. The rings 4 of the holder are elliptical in the transverse direction of the carrier 1. As the holder 1 is slid onto the bottles 2, the shape of the rings is changed from elliptical to circular. The change in the shape of the rings presses one row of bottles against the other. With the holder positioned about halfway down the bottles, the rings form sleeves extending up from the body of the holder as shown in FIG. 4. Tabs 7 can be formed on the inner peripheries of the rings (FIG. 1) so that they project up from the rings on the outer periphery of the carrier when the carrier is slid onto the bottles (FIG. 4). The tabs break the rings open when pulled to allow easy removal of the bottles. This tab feature also reduces the likelihood of animals being trapped in the carrier 1 when it is discarded. integral handle 8 on one edge of the holder 1 allows the pack of bottles to be carried with relative ease.

Figure 3:
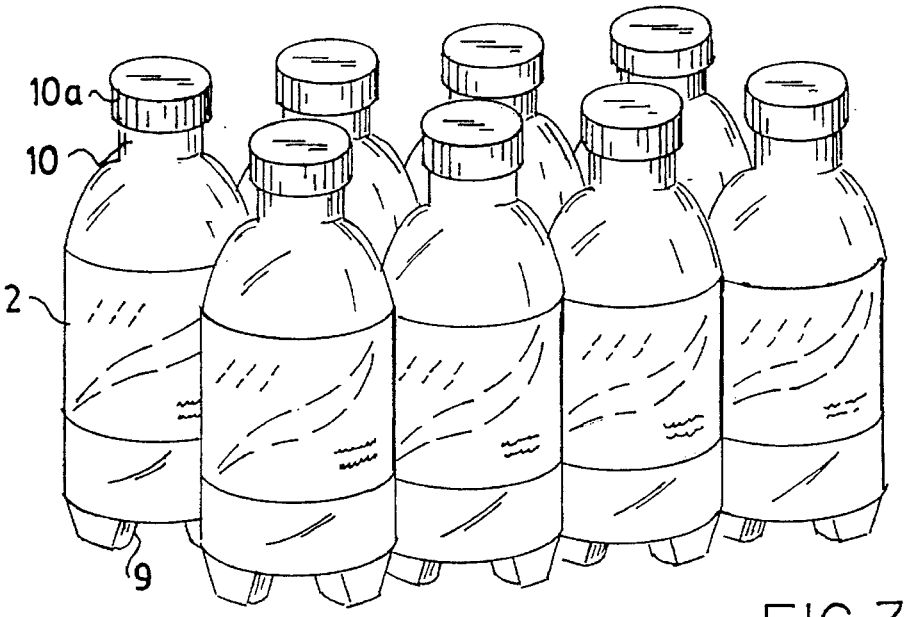
FIG. 3 is a side elevation of the prior art bottles arranged for insertion into the bottle holder.

The bottles 2 used in the invention can be made from glass or plastic. Preferably, as shown in FIG. 3, the bottles 2 have bottom ends 9 shaped to receive the top ends 0 of like bottles. This bottle shape allows easier, more stable stacking of packs of bottles 2 during shipping, storage, and/or display. Typically, the tops of the bottles are sealed with caps 10*a*.

The core of the invention lies in the combination of the promotional card insert 3 with the prior art beverage bottle pack. The promotional card insert 3 is placed between the rows of bottles 2 from above so that it is visible between and through the necks of the bottles. The insert 3 is held in place by the compressive force or friction fit between the bottles 2.

A number of different types of promotional card inserts can be used in the invention. Depending on the particular type of bottles used and the particular placement of the holder, the promotional card insert can be placed in many different positions. The card can abut against the holder or be placed farther up the bottles as long as the card is held in place by the compressive forces between the bottles. The card can be placed to project above the level of the bottle caps, to lie below the level of the bottle caps, or anywhere in between, depending on the size of the particular card. The only limitations on the placement of the card are proper retention of the card by the bottles and absence of interference with a beverage bottle pack above the card in a stack.

The following descriptions of the promotional card insert of the invention are only exemplary in nature. They are not intended to limit the invention to the types of cards described since there are many other ways the cards could be made. The invention is essentially the combination of such cards with the prior art bottle packs as a new promotional display system regardless of the type of card used.

Figure 5:
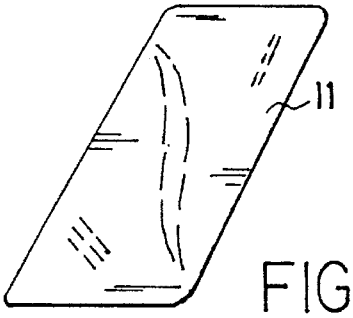
FIG. 5 is a side elevation of a first type of promotional card insert which can be used in the invention.
Figure 5A:
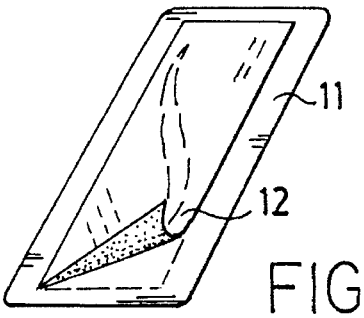
FIG. 5A is a side elevation of a variation of the first type of promotional card insert which can be used in the invention.

The promotional card insert in its simplest form is a rectangular piece of label stock 11 with text and/or graphics printed on one or both sides as shown in FIG. 5. This form can also be used as a card backed by a release layer to serve as a bumper sticker or as a static-cling display device 12 (FIG. 5A) that can be directly inserted into the pack of bottles 2. Such a display device can increase product appeal by giving customers something they can display.

Figure 6:
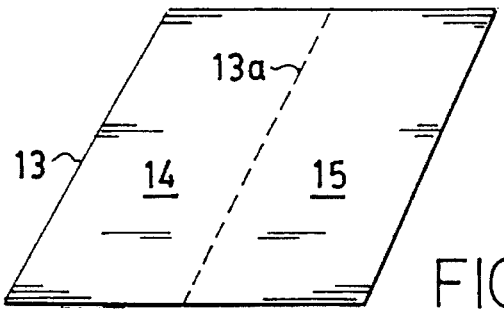
FIGS. 6 and 7 are side elevations of a second type of promotional card insert which can be used in the invention.
Figure 7:
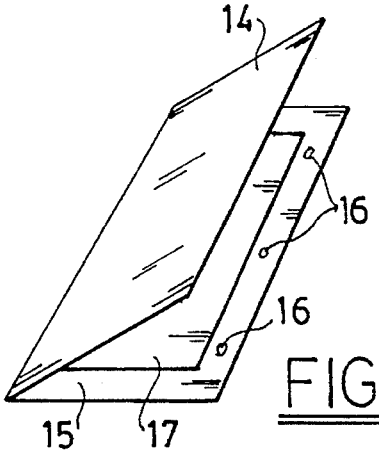

Another type of insert is shown in FIGS. 6 and 7 and is made by scoring a rectangular piece of label stock 13 to form two rectangular sections or panels 14, 15 of equal size. The two sections are then folded along a score 13a and are preferably held together with fugitive adhesive 16. Fugitive adhesive is used to allow opening of the insert with relatively little damage and is preferably applied to unprinted sections of the open end of the insert. This insert is more versatile than a simple card since it can have text and/or graphics printed on its interior surfaces as well as its exterior surfaces. Promotional gifts or prizes 17, such as bumper stickers, static-cling display devices, or small posters, can also be placed inside the insert to further increase product appeal to customers. This form of the insert results in the folded edge of the insert being thicker than the glued edge, which can reduce the ease with which the insert is placed between the bottles by machinery.

Figure 8:
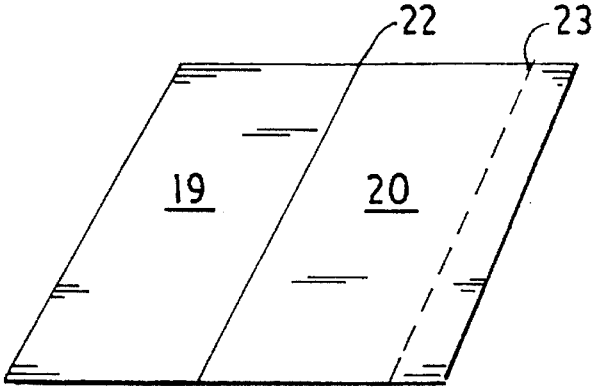
FIGS. 8, 9, and 10 are side elevations of a third type of promotional card insert which can be used in the invention.
Figure 9:
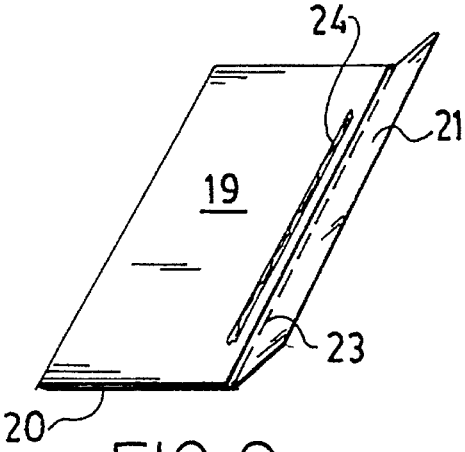
Figure 10:
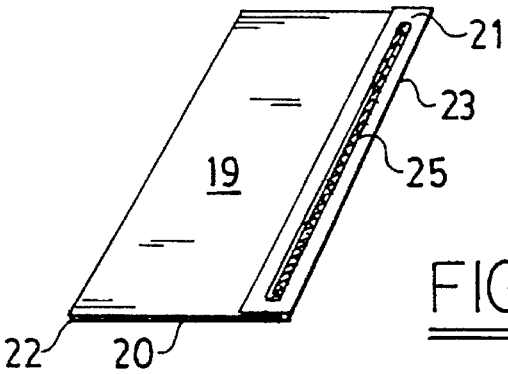

A preferred type of insert is shown in FIGS. 8, 9, and 10. The insert is made by scoring a rectangular piece of label stock 18 in two places to form three rectangular sections or panels 19, 20, 21. First, a bar score 22 is made to form two rectangular panels, one of which is larger than the other. The smaller section 19 is folded over the larger section 20 along the bar score 22. A score line fold 23 is then made near the free end of the larger section to form a third rectangular panel 21 which is folded over the open side of the first two panels. The third panel is held in place by fugitive adhesive 24 applied to areas of the insert left unprinted. A zipper strip 25 can be formed on the exterior surface of the third panel to facilitate opening of the insert. Text and/or graphics can be printed on the interior and exterior surfaces of the insert, and promotional gifts or prizes can be placed within the insert to increase product appeal to customers. The advantage of making the insert in this manner is that the thickness of the folded edge is substantially equal to that of the edge which is folded and glued. This makes the card easier to handle by insertion machinery.

Figure 11:
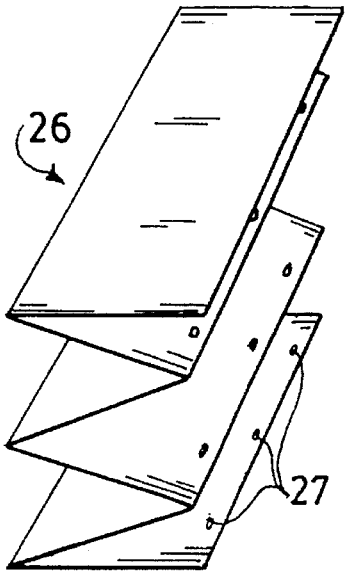
FIG. 11 is a side elevation of a fourth type of promotional card insert which can be used in the invention.

Another type of promotional card insert is shown in FIG. 11. In this case, the insert is made by taking a piece of material 26, such as label stock or a promotional poster of some sort, and folding it like an accordion to form the insert. The open edges of the insert can be held together by adhesive 27.

The promotional card insert has been successfully used with two, three, and four folded panels in addition to the simple one-panel card and could easily be used with more folded panels. Small posters have also been folded up and successfully inserted into the pack of bottles. Regardless of the number of panels or the specific types of materials used, all inserts in a given batch to be inserted preferably have the same thickness to facilitate handling by the machinery which inserts the cards into the packs of bottles. With current carriers and bottles, the cards are preferably no more than 0.040 inches thick to ensure that they will fit between the bottles. However, because the rows of bottles are actually in contact, no card is too thin as long as it can be placed between the bottles by the insertion machinery.

I claim:

1. A promotional card insert display system comprising:

a promotional card insert placed between contacting rows of bottles of a bottle pack held by a holder separate from the promotional card insert, wherein the bottles exert compressive forces against opposite sides of the insert, which result from the action of the holder on the bottles, the insert thus placed being visible between necks of the bottles;

the bottle holder comprising:

a single sheet of plastic forming at least two rows of rings and webbing connecting the rings, the rings holding respective bottles in at least two rows and pressing at least one row of bottles against at least one other row of bottles; and the bottles held by the holder each comprising a top end and a bottom end, each top end including a respective neck.

2. The display system of claim 1 wherein the insert projects above the tops of the bottles, but avoids interference with a bottle pack above the insert.

3. The display system of claim 1 wherein the holder also has at least one handle formed on its periphery; and when the bottle pack is carried by the at least one handle, the card insert remains held in place.

4. The display system of claim 1 wherein the insert comprises:

a single piece of material folded along at least one score across the material to form multiple layers of material with adhesive holding the layers together at open edges of the insert.

5. The display system of claim 4 wherein at least two scores divide the piece of material into at least two regions of substantially equal dimension and an additional region of smaller dimension, the equal regions being folded together and the additional region being folded to cover and hold closed an open side of the insert, the additional region being held in place by adhesive.

6. The display system of claim 5 wherein a zipper strip is formed in the additional region to facilitate opening of the folded insert.

7. The display system of claim 1 wherein the insert comprises:

a piece of a first material folded to form at least two layers held together by adhesive; and at least one piece of a second material placed between and held in place by layers of the piece of the first material.

8. A promotional card insert display system comprising:

a promotional card insert engaged by at least four bottles of a bottle pack wherein the bottles are arranged in contacting rows, at least one row on each side of the card insert;

the bottles comprising bottom ends, and top ends with necks shaped such that when the bottles are adjacent one another, there are gaps between the necks through which the card insert can be seen;

a holder, separate from the promotional card insert, that holds the bottles substantially about mid-sections of the bottles, the holder comprising:

a single piece of plastic forming rings that, when slid onto the bottles, force at least one row of bottles to contact at least one other row of bottles;

the placement of the holder and the shape of the bottles allowing the card insert to be seen from outside the bottle pack; and the insert being arranged such that it is substantially parallel to an axis extending between a center of the top end of a bottle and a center of the bottom end of the bottle.

9. The display system of claim 8 wherein the insert projects above the tops of the bottles, but avoids interference with a bottle pack above the insert.

10. The display system of claim 8 wherein the holder also has at least one handle formed on its periphery; and when the bottle pack is carried by the at least one handle, the card insert remains held in place.

11. The display system of claim 8 wherein the insert comprises:

a single piece of material folded along at least one score across the material to form multiple layers of material with adhesive holding the layers together at open edges of the insert.

12. The display system of claim 11 wherein at least two scores divide the piece of material into at least two regions of substantially equal dimension and an additional region of smaller dimension, the equal regions being folded together and the additional region being folded to cover and hold closed an open side of the insert, the additional region being held in place by adhesive.

13. The display system of claim 12 wherein a zipper strip is formed in the additional region to facilitate opening of the folded insert.

14. The display system of claim 8 wherein the insert comprises:

a piece of a first material folded to form at least two layers held together by adhesive; and at least one piece of a second material placed between and held in place by layers of the piece of the first material.

15. A promotional card insert display system comprising:

a promotional card insert held in a bottle pack by a friction fit resulting from the action of a holder on at least one row of bottles on each side of the insert, the insert thus placed being visible between necks of the bottles and held firmly enough by the friction fit that the insert remains in place when the bottle pack is carried;

the bottle holder being separate from the promotional card insert and comprising:

a single sheet of plastic forming at least two rows of rings and webbing between the rings, the rings holding respective bottles in at least two rows pressed respectively against opposite sides of the insert; and the bottles held by the holder each comprise:

a top end including a neck, and a sealed bottom end shaped to receive the top end of a like bottle when the bottles are stacked.

16. The display system of claim 15 wherein the insert projects above the tops of the bottles, but avoids interference with a bottle pack above the insert.

17. The display system of claim 15 wherein the holder further comprises at least one handle formed on at least one edge of the piece of plastic to allow the holder and bottles to be carried such that the card insert remains in place when the bottle pack is carried by the at least one handle.

18. The display system of claim 15 wherein the insert comprises:

a single piece of material folded along at least one score across the material to form multiple layers of material with adhesive holding the layers together at open edges of the insert.

19. The display system of claim 18 wherein at least two scores divide the piece of material into at least two regions of substantially equal dimension and an additional region of smaller dimension, the equal regions being folded together and the additional region being folded to cover and hold closed an open side of the insert, the additional region being held in place by adhesive.

20. The display system of claim 19 wherein a zipper strip is formed in the additional region to facilitate opening of the folded insert.

21. The display system of claim 15 wherein the insert comprises:

a piece of a first material folded to form at least two layers held together by adhesive; and at least one piece of a second material placed between and held in place by layers of the piece of the first material.

* * * * *